US010012918B2

(12) United States Patent
Ishigami et al.

(10) Patent No.: US 10,012,918 B2
(45) Date of Patent: Jul. 3, 2018

(54) TONER AND METHOD FOR PRODUCING TONER

(71) Applicant: CANON KABUSHIKI KAISHA, Tokyo (JP)

(72) Inventors: Koh Ishigami, Abiko (JP); Takeshi Ohtsu, Toride (JP); Kentaro Kamae, Kashiwa (JP); Ryuichiro Matsuo, Moriya (JP); Yosuke Iwasaki, Abiko (JP); Wakiko Katsumata, Kashiwa (JP); Kenta Mitsuiki, Toride (JP); Masaharu Miura, Toride (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/431,821

(22) Filed: Feb. 14, 2017

(65) Prior Publication Data

US 2017/0242355 A1 Aug. 24, 2017

(30) Foreign Application Priority Data

Feb. 19, 2016 (JP) ..... 2016-029488

(51) Int. Cl.
*G03G 9/097* (2006.01)
*G03G 9/08* (2006.01)

(52) U.S. Cl.
CPC ..... *G03G 9/0806* (2013.01); *G03G 9/08* (2013.01); *G03G 9/0802* (2013.01)

(58) Field of Classification Search
CPC ..... G03G 9/08786; G03G 9/08782; G03G 9/08755; G03G 9/08711; G03G 9/08704
See application file for complete search history.

(56) References Cited

U.S. PATENT DOCUMENTS 5,389,487 A * 2/1995 Kawakami ..... G03G 9/08711 430/109.3
7,279,262 B2 10/2007 Fujikawa et al.
7,288,348 B2 10/2007 Hayami et al.
7,396,626 B2 7/2008 Fujikawa et al.
(Continued)

FOREIGN PATENT DOCUMENTS

JP 2007-264349 10/2007
JP 2011-123352 6/2011

OTHER PUBLICATIONS

U.S. Appl. No. 15/244,439, filed Aug. 23, 2016, Takeshi Ohtsu.

*Primary Examiner* — Peter L Vajda

(74) *Attorney, Agent, or Firm* — Fitzpatrick Cella Harper and Scinto

(57) ABSTRACT

A toner having a toner particle that is produced through a step of melt-kneading a resin composition containing a binder resin, a colorant, a hydrocarbon wax, and a wax dispersing agent, cooling the obtained kneaded material, pulverizing the obtained cooled material, and heat treating the resulting resin particles, wherein the wax dispersing agent is a polymer provided by graft polymerizing a styrene-acrylic polymer onto a polypropylene, the styrene-acrylic polymer is a polymer having a monomer unit derived from a cycloalkyl (meth)acrylate, and specific relationships are satisfied where Mp(p) is the melting point (° C.) of the polypropylene and Mp(w) is the melting point (° C.) of the hydrocarbon wax.

4 Claims, 2 Drawing Sheets

(56) References Cited

U.S. PATENT DOCUMENTS

| | | | |
|---|---|---|---|
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,945,805 | B2 | 2/2015 | Baba et al. |
| 8,974,994 | B2 | 3/2015 | Kamae et al. |
| 8,986,914 | B2 | 3/2015 | Fujikawa et al. |
| 9,034,551 | B2 | 5/2015 | Endo et al. |
| 9,046,800 | B2 | 6/2015 | Hotta et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,152,088 | B1 | 10/2015 | Kobori et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 2010/0028796 | A1 | 2/2010 | Nakamura et al. |
| 2010/0183971 | A1 | 7/2010 | Fujikawa et al. |
| 2012/0214097 | A1 | 8/2012 | Naka et al. |
| 2012/0264043 | A1* | 10/2012 | Watanabe ..... G03G 9/0806 430/108.8 |
| 2013/0244159 | A1 | 9/2013 | Ishigami et al. |
| 2013/0309603 | A1 | 11/2013 | Takahashi et al. |
| 2014/0096409 | A1 | 4/2014 | Ohtsu et al. |
| 2014/0101966 | A1 | 4/2014 | Minagawa et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0177634 | A1 | 6/2015 | Kamae et al. |
| 2015/0185657 | A1* | 7/2015 | Matsui ..... G03G 9/0833 430/105 |
| 2015/0253686 | A1* | 9/2015 | Miyakoshi ..... G03G 9/08755 430/109.4 |
| 2016/0109820 | A1 | 4/2016 | Hashimoto et al. |
| 2016/0334725 | A1 | 11/2016 | Katsumata et al. |

* cited by examiner

TONER AND METHOD FOR PRODUCING TONER

BACKGROUND OF THE INVENTION

Field of the Invention

The present invention relates to a toner for use in electrophotographic systems, electrostatic recording systems, electrostatic printing systems, and toner jet systems, and the present invention also relates to a method of producing the toner.

Description of the Related Art

Electrophotographic system full-color copiers have entered into widespread use in recent years, and their application in the printing market has also begun. The printing market requires high speeds, high image quality, and high productivity while accommodating a broad range of media (paper types). For example, there is demand for a constant media speed capacity even when the paper type is changed from thick paper to thin paper, i.e., the ability to continue printing without executing a change in process speed depending on paper type and without executing a change in the heating set temperature at the fixing unit.

In order to accommodate this constant media speed capacity, it has come to be required of toner that an appropriate fixing be achieved within a broad range of fixation temperatures from low temperatures to high temperatures.

One method for bringing about an appropriate fixing of toner over a broad range of fixation temperatures is to endow the toner with releasability by incorporating a wax in the toner. In this case, a microfine and uniform state of dispersion of the wax in the toner is desirable because a substantial effect is exerted on the properties of the toner.

In order to control the state of wax dispersion in toner, Japanese Patent Application Laid-open No. 2007-264349 proposes an art in which a wax dispersing agent is incorporated in the toner.

In addition, various toners having an improved low-temperature fixability achieved by the addition to the toner of a crystalline resin having a sharp melt property are also proposed in Japanese Patent Application Laid-open No. 2011123352 for the purpose of accomplishing fixing over a broad range of temperatures at which fixing is possible.

SUMMARY OF THE INVENTION

However, even with the control in accordance with Japanese Patent Application Laid-open No. 2007-264349 of the state of the wax dispersion in the toner immediately after production, when the toner is held in a high-temperature, high-humidity environment or is subjected to a post-treatment such as a heat-sphering treatment, the wax migrates to the neighborhood of the toner surface and as a result the flowability of the toner can decline and the charging performance can deteriorate.

In the case of Japanese Patent Application Laid-open No. 2011-123352, the low-temperature fixability is still not satisfactory for high-speed machines; in addition, blocking can occur in the event of long-term standing under a high-temperature, high-humidity environment. In particular, a melt-kneaded and pulverized toner produced by melt-kneading with a crystalline resin has a low viscosity during kneading and as a result it is difficult to develop a satisfactory kneading load during kneading. As a consequence, various materials in the toner, e.g., the pigment and wax, are not adequately dispersed and, for example, the charging performance can deteriorate.

Thus, as indicated above, there is still room for investigation into controlling the state of wax dispersion in toner in order to bring about a satisfactory charging performance, low-temperature fixability, and blocking resistance.

The present invention provides a toner that solves the problems described in the preceding.

It specifically provides a toner in which the state of dispersion of the wax incorporated in the toner particle is controlled and in which the migration of wax to the toner particle surface is controlled.

The present invention also provides a toner that, while providing a satisfactory low-temperature fixability and blocking resistance, can exhibit a satisfactory charging performance and can do so even in a high-temperature, high-humidity environment.

The present invention relates to a toner having a toner particle that is produced through a step of melt-kneading a resin composition containing a binder resin, a colorant, a hydrocarbon wax, and a wax dispersing agent, cooling the obtained kneaded material, pulverizing the obtained cooled material, and heat treating the resulting resin particle, wherein the wax dispersing agent comprises a polymer provided by graft polymerizing a styrene-acrylic polymer onto a polypropylene, the styrene-acrylic polymer is a polymer having a monomer unit derived from a cycloalkyl (meth)acrylate, and the following formula (1) and formula (2) are satisfied where Mp(p) is the melting point (° C.) of the polypropylene and Mp(w) is the melting point (° C.) of the hydrocarbon wax.

$$70 \leq Mp(p) \leq 90 \quad (1)$$

$$|Mp(p) - Mp(w)| \leq 20 \quad (2)$$

The present invention also relates to a method of producing a toner, comprising the steps of:

obtaining a kneaded material by melt-kneading a resin composition containing a binder resin, a colorant, a hydrocarbon wax, and a wax dispersing agent;

cooling the kneaded material to obtain a cooled material;

pulverizing the cooled material to obtain a resin particle; and heat treating the resin particle, wherein the wax dispersing agent comprises a polymer provided by graft polymerizing a styrene-acrylic polymer onto a polypropylene, the styrene-acrylic polymer is a polymer having a monomer unit derived from a cycloalkyl (meth)acrylate, and the following formula (1) and formula (2) are satisfied where Mp(p) is a melting point (° C.) of the polypropylene and Mp(w) is a melting point (° C.) of the hydrocarbon wax:

$$70 \leq Mp(p) \leq 90 \quad (1)$$

$$|Mp(p) - Mp(w)| \leq 20 \quad (2).$$

Further features of the present invention will become apparent from the following description of exemplary embodiments with reference to the attached drawings.

DESCRIPTION OF THE EMBODIMENTS

Figure 1:
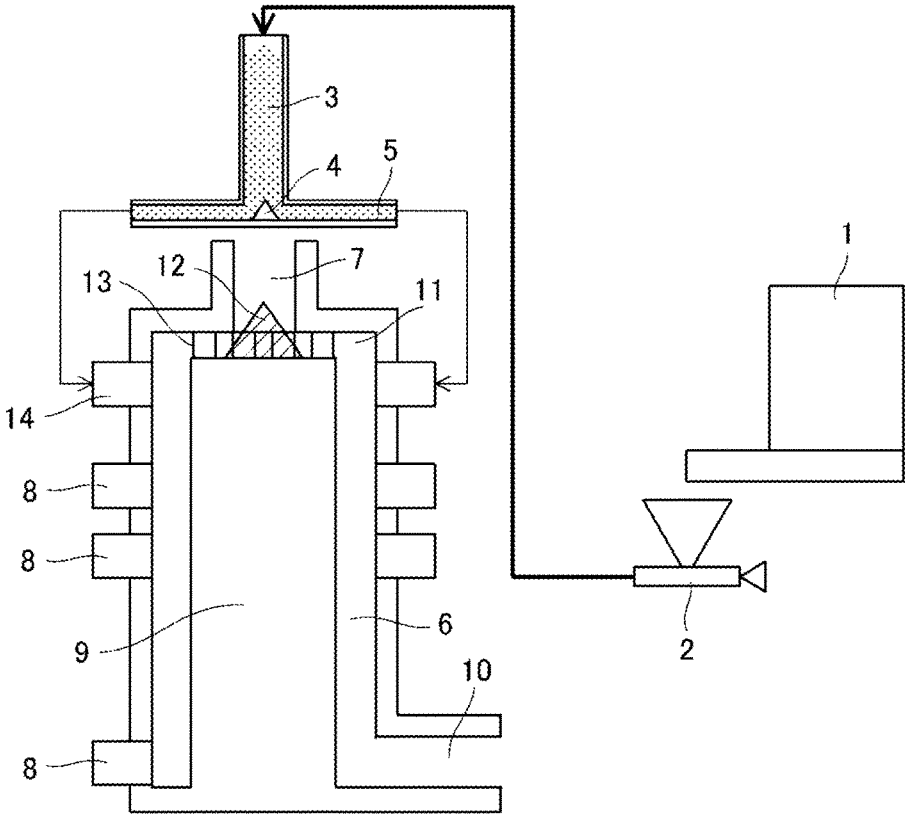
FIG. 1 is a schematic diagram of a heat sphering treatment apparatus.

Unless specifically indicated otherwise, for the present invention phrases such as "at least XX and not more than YY" and "XX to YY" that indicate a range of numerical values denote a numerical value range that includes the lower limit and upper limit that are the end points.

The toner of the present invention is a toner having a toner particle that is produced through a step of melt-kneading a resin composition containing a binder resin, a colorant, a hydrocarbon wax, and a wax dispersing agent, cooling the obtained kneaded material, pulverizing the obtained cooled material, and heat treating the resulting resin particle, wherein the wax dispersing agent comprises a polymer (also referred to hereafter as the graft polymer) provided by graft polymerizing a styrene-acrylic polymer onto a polypropylene, the styrene-acrylic polymer is a polymer having a monomer unit derived from a cycloalkyl (meth)acrylate, and the following formula (1) and formula (2) are satisfied where Mp(p) is the melting point (° C.) of the polypropylene and Mp(w) is the melting point (° C.) of the hydrocarbon wax.

$$70 \leq Mp(p) \leq 90 \quad (1)$$

$$|Mp(p) - Mp(w)| \leq 20 \quad (2)$$

The toner of the present invention is a toner having a toner particle that is produced through a step of melt-kneading a resin composition containing a binder resin, a colorant, a hydrocarbon wax, and a wax dispersing agent, cooling the obtained kneaded material, pulverizing the obtained cooled material, and heat treating the resulting resin particle. In addition, the graft polymer having a specific structure and properties is used as the wax dispersing agent in the toner.

The wax dispersion agent here is a polymer provided by the graft polymerization of a styrene-acrylic polymer onto a polypropylene.

A toner for which the wax dispersity is controlled and wax migration to the toner surface is suppressed can be provided when the aforementioned formula (1) and formula (2) are satisfied where Mp(p) is the melting point (° C.) of the polypropylene and Mp(w) is the melting point (° C.) of the hydrocarbon wax.

The polypropylene fraction of the wax dispersing agent has a polarity close to that of the hydrocarbon wax among the constituent materials of the toner particle, while the Styrene-acrylic polymer fraction has a polarity close to that of the binder resin.

Thus, this wax dispersing agent, by having structure provided by the graft polymerization of a styrene-acrylic polymer onto polypropylene, can then reside interposed at the hydrocarbon wax/binder resin interface.

That is, by behaving like a surfactant between the hydrocarbon wax and binder resin, the wax dispersing agent can bring about the microdispersion of the hydrocarbon wax in the toner particle.

In addition, the use of polypropylene is critical for increasing the wax-dispersing effect of the wax dispersing agent. Polypropylene contains a large number of tertiary carbons and thus contains a large number of sites where a graft reaction can occur through hydrogen abstraction, and as a consequence an increase in the grafting ratio is made possible and the dispersing effect on the hydrocarbon wax can then be increased.

It is known that, when a toner undergoes extended holding in a high-temperature, high-humidity environment, generally the wax in the toner particle gradually migrates to the toner particle surface. When the wax undergoes migration to the toner particle surface, commonly the wax dispersing agent can also migrate to the toner particle surface along with the wax.

Even when the wax dispersing agent does migrate to the toner particle surface, it is thought that with the present invention the exposure of the hydrocarbon wax at the toner surface is suppressed because the styrene-acrylic polymer has a monomer unit derived from a bulky cycloalkyl (meth) acrylate.

As a result, it is thought that, even when the toner is subjected to extended standing in a high-temperature, high-humidity environment, the flowability of the toner is not impaired and the blocking resistance is also improved and the charging performance is not degraded.

Moreover, even when the wax dispersing agent does migrate to the toner particle surface, it is thought that, due to the high hydrophobicity of the monomer unit derived from the bulky cycloalkyl (meth)acrylate, the hydrophobicity of the toner particle surface is then increased and moisture absorption is suppressed even upon standing in a high-temperature, high-humidity environment and problems such as, e.g., an impaired charging, can be avoided.

As indicated above, the following formula (1) and formula (2) are satisfied where Mp(p) is the melting point (° C.) of the polypropylene and Mp(w) is the melting point (° C.) of the hydrocarbon wax.

$$70 \leq Mp(p) \leq 90 \quad (1)$$

$75 \leq Mp(p) \leq 87$ is preferred.

$$|Mp(p) - Mp(w)| \leq 20 \quad (2)$$

$|Mp(p) - Mp(w)| \leq 15$ is preferred.

A toner particle having the hydrocarbon wax in a microdispersed state is provided when Mp(p) and Mp(w) satisfy these relationships. Since, with the toner of the present invention, the hydrocarbon wax and wax dispersing agent undergo solidification in the same temperature band in the cooling process that follows melt-kneading, it is thought that the hydrocarbon wax and wax dispersing agent undergo solidification in a state of proximity.

Thus, it is thought that the wax dispersing agent also undergoes solidification at the binder resin/hydrocarbon wax interface, with the hydrocarbon wax maintaining its microdispersed state as such.

The polypropylene constituting the wax dispersing agent, while having a melting point close to that of the hydrocarbon wax, has a molecular weight that is at least an order of magnitude larger than that of the hydrocarbon wax. As a consequence, in the case of extended standing in a high-temperature, high-humidity environment or even upon exposure to high temperatures due to the execution of a heat treatment, migration of the wax dispersing agent itself to the toner particle surface is impeded.

It is hypothesized that as a consequence the wax dispersing agent then functions as an anchor to inhibit the migration of the hydrocarbon wax itself to the toner particle surface, thereby enabling the maintenance of the microdispersed state of the hydrocarbon wax.

Here, when this [Mp(p)] exceeds 90° C., the polypropylene takes on a high softening point and a large molecular weight and the viscosity as a wax dispersing agent then ends up increasing.

As a result, an effect is also exerted on the viscosity of the toner, and in particular the low-temperature fixability declines.

When, on the other hand, this [Mp(p)] is less than 70° C., the wax dispersing agent assumes a low viscosity when the toner is subjected to heat and in addition the polypropylene also has a low molecular weight, and as a consequence migration of the wax dispersing agent to the toner surface is also facilitated.

As a result, the expression of the inhibitory effect on hydrocarbon wax migration to the toner particle surface is impaired and the charging performance is reduced.

When |Mp(p)−Mp(w)| exceeds 20° C., a difference in the timing of solidification by the polypropylene and the hydrocarbon wax is produced. Thus, the hydrocarbon wax solidifies after the polypropylene fraction in the wax dispersing agent has solidified, or the hydrocarbon wax solidifies first and the polypropylene fraction solidifies after this. As a consequence, the ability of the wax dispersing agent to be present interposed at the hydrocarbon wax/binder interface is impaired and the wax dispersity then declines.

Moreover, the appearance of the anchoring effect is also impeded due to the absence of the wax dispersing agent at the interface, and when the toner particle is subjected to heat the hydrocarbon wax then migrates to the toner particle surface and the toner flowability is reduced and the charging performance is reduced.

The mass ratio of the polypropylene to the styrene-acrylic polymer in the wax dispersing agent is preferably 1:99 to 30:70 and is more preferably 3:97 to 20:80.

The content of the wax dispersing agent in the toner particle in the present invention is preferably at least 1 mass % and not more than 20 mass % and more preferably at least 3 mass % and not more than 10 mass %.

The mass ratio of the wax dispersing agent to the wax (wax dispersing agent/wax) in the present invention is preferably at least 0.4 and not more than 5.0 and more preferably at least 0.8 and not more than 3.0.

The softening point (Tm) of the wax dispersing agent is preferably at least 100° C. and not more than 130° C. and more preferably at least 115° C. and not more than 125° C.

There are no particular limitations in the present invention on the method for graft polymerizing the styrene-acrylic polymer onto the polypropylene, and heretofore known methods can be used here.

The styrene-acrylic polymer in the present invention is a polymer that has a monomer unit derived from a cycloalkyl (meth)acrylate.

Here, cycloalkyl (meth)acrylate denotes a cycloalkyl acrylate or a cycloalkyl methacrylate.

This monomer unit derived from a cycloalkyl (meth) acrylate can be represented by the following formula (3). Here, monomer unit refers to the reacted form of the monomeric substance in the polymer.

(3)

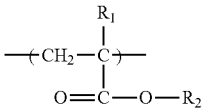

[In formula (3), $R_1$ represents a hydrogen atom or methyl group and $R_2$ represents a cycloalkyl group.]

This $R_2$ is preferably a cycloalkyl group having at least 3 and not more than 18 carbons and is more preferably a cycloalkyl group having at least 4 and not more than 12 carbons.

The cycloalkyl group can be specifically exemplified by the cyclopropyl group, cyclobutyl group, cyclopentyl group, cyclohexyl group, t-butylcyclohexyl group, cycloheptyl group, and cyclooctyl group.

The cycloalkyl group can also have, for example, an alkyl group, halogen atom, carboxy group, carbonyl group, hydroxy group, and so forth as a substituent. The alkyl group is preferably an alkyl group having at least 1 and not more than 4 carbons.

The location and number of the substituents may be freely selected, and, when two or more substituents are present, they may be the same as each other or may differ from one another.

The content in the present invention of the monomer unit with formula (3), per 100 mass parts of the overall monomer units constituting the wax dispersing agent, is preferably at least 1 mass parts and not more than 40 mass parts and more preferably at least 5 mass parts and not more than 15 mass parts.

Viewed from the standpoint of the hydrophobicity, cyclohexyl methacrylate is preferred for the monomer unit derived from a cycloalkyl (meth)acrylate in the wax dispersing agent. The use of cyclohexyl methacrylate enhances the hydrophobicity of the wax dispersing agent and can thus bring about a reduction in the amount of water absorption by the wax dispersing agent. It is thought that as a result the moisture absorption in a high-temperature, high-humidity environment can also be reduced and the charging properties are improved.

The binder resin in the present invention preferably contains a crystalline polyester resin and an amorphous polyester resin. The content of the amorphous polyester resin in the binder resin is preferably at least 50 mass %. Insofar as the effects of the present invention are not impaired, the binder resin may contain resins known for toner use other than the crystalline polyester resin and amorphous polyester resin.

A suitable selection from amorphous saturated polyester resins, amorphous unsaturated polyester resins, or both can be used as the amorphous polyester resin.

Common amorphous polyester resins constituted of an alcohol component and a carboxylic acid component can be used as the amorphous polyester resin here, and examples of these two components are given below.

The alcohol component can be exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives as given by the following formula (I), the hydrogenates of formula (I), and the diols given by the following formula (II).

(I)

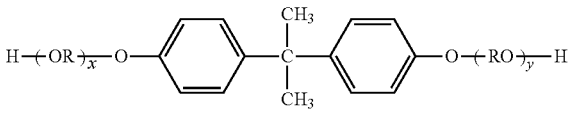

[In the formula, R is an ethylene group or propylene group; x and y are each integers equal to or greater than 1; and the average value of x+y is 2 to 10.]

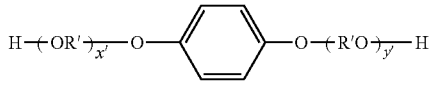

(II)

[In the formula, R' is

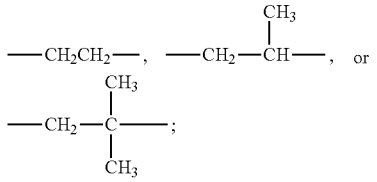

x' and y' are each integers equal to or greater than 0; and the average value of x'+y' is at least 0 and not more than 10.]

The dibasic carboxylic acid component, on the other hand, can be exemplified by benzenedicarboxylic acids or their anhydrides, e.g., phthalic acid, terephthalic acid, isophthalic acid, and phthalic anhydride; and alkyldicarboxylic acids, e.g., succinic acid, adipic acid, sebacic acid, and azelaic acid, or their anhydrides.

Additional examples are succinic acid substituted by a $C_6$ to $C_{18}$ alkyl group or alkenyl group, and anhydrides thereof, and unsaturated dicarboxylic acids, e.g., fumaric acid, maleic acid, citraconic acid, and itaconic acid, and anhydrides thereof.

The polyhydric alcohol component can be exemplified by glycerol, pentaerythritol, sorbitol, sorbitan, and the oxyalkylene ethers of novolac-type phenolic resins. The polybasic carboxylic acid component can be exemplified by trimellitic acid, pyromellitic acid, 1,2,3,4-butanetetracarboxylic acid, and benzophenenetetracarboxylic acid and anhydrides of the preceding.

The amorphous polyester resin can be produced using commonly used catalysts, for example, any catalyst from, e.g., metals such as tin, titanium, antimony, manganese, nickel, zinc, lead, iron, magnesium, calcium, and germanium and compounds that contain these metals. Among these catalysts, amorphous polyester resins provided by condensation polymerization using a titanium catalyst are particularly preferred.

With amorphous polyester resins provided by condensation polymerization using a titanium catalyst, a homogeneous polyester resin is readily obtained and as a consequence there is also little variability among toner particles.

Viewed from the perspective of charge stability, the amorphous polyester resin preferably has an acid value of at least 1 mg KOH/g and not more than 30 mg KOH/g. By having the acid value be not more than 30 mg KOH/g, stabilization of the charging performance of the toner is facilitated and as a consequence improvements in the developing efficiency are facilitated particularly in high-temperature, high-humidity environments.

A blend of an amorphous polyester resin A having a low softening point with an amorphous polyester resin B having a high softening point may be used as the amorphous polyester resin. Viewed in terms of the low-temperature fixability and the hot offset resistance, the content ratio (A/B) between the amorphous polyester resin A and the amorphous polyester resin B is preferably 50/50 to 95/5 on a mass basis.

Here, the softening point of the amorphous polyester resin A is preferably at least 65° C. and not more than 110° C., while the softening point of the amorphous polyester resin B is preferably at least 115° C. and not more than 150° C.

Additional improvements in the plasticization of the toner during fixing can be brought about in the present invention by having the binder resin contain an amorphous polyester resin and a crystalline polyester resin.

In addition, the incorporation of an amorphous polyester resin and crystalline polyester resin enables fixing at lower temperatures and is thus also preferred from the standpoint of being able to bring about an enhanced low-temperature fixability.

Moreover, it was confirmed that the combination of this wax dispersing agent with the crystalline polyester resin resulted in an improvement in not just the dispersity of the hydrocarbon wax, but also in the dispersity of the colorant.

In the case of production by the melt-kneading of a toner that contains a crystalline polyester resin, generally the dispersity of, e.g., the colorant, may be lowered due to a reduction in the viscosity of the melt-kneaded system. As a result, the toner consumption required for image formation then ends up increasing due to the reduced tinting strength and consequent larger toner laid-on level. However, with the toner of the present invention, it was confirmed that a high tinting strength is developed and the colorant is microfinely dispersed.

Thus, it is hypothesized that the subject wax dispersing agent also functions as a viscosity modifier and a compatibilizer for the crystalline polyester resin-containing melt-kneaded system.

Since the hydrocarbon wax has a polarity close to that of the crystalline polyester resin, it is thought that the subject wax dispersing agent has a structure and polarity that can bring about the dispersion and compatibilization of the crystalline polyester resin in the resin component.

While the melting point of the polypropylene fraction of the wax dispersing agent is low, which is at least 70° C. and not more than 90° C., for example, its molecular weight is at least one order of magnitude larger than the polypropylene commonly used for toner waxes. Accordingly, the graft-polymerized wax dispersing agent used by the present invention exhibits an additional boost in its molecular weight from the polypropylene. That is, in addition to the dispersing effect and compatibilizing effect of this wax dispersing agent, it is thought that a viscosity-increasing effect also accrues due to the boosted molecular weight of the wax dispersing agent, and that the dispersity of the colorant is then increased—even with a kneaded material that contains a crystalline polyester resin—and the tinting strength of the toner is increased.

The content of the crystalline polyester resin, per 100 mass parts of the amorphous polyester resin, is preferably at least 1.0 mass part and not more than 15.0 mass parts and more preferably at least 2.0 mass parts and not more than 10.0 mass parts. When the content of the crystalline polyester resin is in the indicated range, a satisfactory low-temperature fixability is exhibited and the crystalline polyester resin can be microfinely dispersed, making this more preferred.

The crystalline polyester resin can be obtained by the reaction of a diol with a dibasic or higher carboxylic acid. Among such crystalline polyester resins, resins obtained by the condensation polymerization of an aliphatic diol and an aliphatic dicarboxylic acid are preferred for their high crystallinity. In addition, only a single crystalline polyester resin may be used or a plurality may be used in combination in the present invention.

In the present invention, a crystalline resin is a resin for which an endothermic peak is observed in differential scanning calorimetry (DSC).

The crystalline polyester resin in the present invention is preferably a condensation polymer of the following: an alcohol component containing at least one compound selected from the group consisting of aliphatic diols having at least 2 and not more than 22 carbons and derivatives thereof, and a carboxylic acid component containing at least one compound selected from the group consisting of aliphatic dicarboxylic acids having at least 2 and not more than 22 carbons and derivatives thereof.

Viewed from the standpoint of the low-temperature fixability and blocking resistance, among the preceding, this crystalline polyester resin is more preferably a condensation polymer of the following: an alcohol component containing at least one compound selected from the group consisting of aliphatic diols having at least 6 and not more than 12 carbons and derivatives thereof, and a carboxylic acid component containing at least one compound selected from the group consisting of aliphatic dicarboxylic acids having at least 6 and not more than 12 carbons and derivatives thereof.

The aforementioned aliphatic diol having at least 2 and not more than 22 carbons (preferably at least 6 and not more than 12 carbons) is not particularly limited, but is preferably a chain (more preferably a straight chain) aliphatic diol.

Examples are ethylene glycol, diethylene glycol, triethylene glycol, 1,2-propylene glycol, dipropylene glycol, 1,3-propanediol, 1,4-butanediol, 1,4-butadiene glycol, 1,5-pentanediol, neopentyl glycol, 1,6-hexanediol, 1,7-heptanediol, 1,8-octanediol, 1,9-nonanediol, 1,10-decanediol, 1,11-undecanediol, and 1,12-dodecanediol.

Preferred examples among the preceding are straight-chain aliphatic α,ω-diols such as 1,6-hexanediol, 1,7-heptanediol, 1,8-octanediol, 1,9-nonanediol, 1,10-decanediol, 1,11-undecanediol, and 1,12-dodecanediol.

There are no particular limitations on the derivative in the present invention as long as the same resin structure is obtained by the aforementioned condensation polymerization example is a derivative provided by the esterification of a diol as described above.

For the alcohol component constituting the crystalline polyester resin, in the present invention the at least one compound selected from the group consisting of the aforementioned aliphatic diols having at least 2 and not more than 22 carbons (preferably at least 6 and not more than 12 carbons) and derivatives thereof is preferably at least 50 mass % and more preferably at least 70 mass % of the total alcohol component.

A polyhydric alcohol other than the aforementioned aliphatic diols can also be used in the present invention.

Among these polyhydric alcohols, diols other than the aforementioned aliphatic diols can be exemplified by 1,4-cyclohexanedimethanol and aromatic alcohols such as polyoxyethylenated bisphenol A and polyoxypropylenated bisphenol A.

Among the polyhydric alcohols, trihydric or higher alcohol monomers can be exemplified by aromatic alcohols such as 1,3,5-trihydroxymethylbenzene and by aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

On the other hand, the aliphatic dicarboxylic acid having at least 2 and not more than 22 carbons (more preferably at least 6 and not more than 12 carbons) is not particularly limited, but is preferably a chain (more preferably a straight chain) aliphatic dicarboxylic acid.

It can be exemplified by oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid. Also included here are the products of the hydrolysis of the acid anhydride or lower alkyl ester of the preceding.

There are no particular limitations in the present invention on the derivative as long as it provides the same resin structure by the aforementioned condensation polymerization. Examples are the anhydride of the dicarboxylic acid component and the derivatives provided by the methyl esterification or ethyl esterification of the dicarboxylic acid component or provided by its conversion into the acid chloride.

For the carboxylic acid component constituting the crystalline polyester resin, in the present invention the at least one compound selected from the group consisting of, the aforementioned aliphatic dicarboxylic acids having at least 2 and not more than 22 carbons (preferably at least 6 and not more than 12 carbons) and derivatives thereof is preferably at least 50 mass % and more preferably at least 70 mass % of the total carboxylic acid component.

A polybasic carboxylic acid other than the aforementioned aliphatic dicarboxylic acid can also be used in the present invention. Among such polybasic carboxylic acids, dibasic carboxylic acids other than the aforementioned aliphatic dicarboxylic acids can be exemplified by aromatic carboxylic acids such as isophthalic acid and terephthalic acid, aliphatic carboxylic acids such as n-dodecylsuccinic acid and n-dodecenylsuccinic acid, and alicyclic carboxylic acids such as cyclohexanedicarboxylic acid, wherein the anhydrides and lower alkyl esters of the preceding are also included here.

The tribasic or higher carboxylic acids among these other polybasic carboxylic acids can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid, and aliphatic carboxylic acids such as 1,2,4-butanetricarboxylic acid, 1,2,5-hexanetricarboxylic acid, and 1,3-dicarboxy-2-methyl-2-methylenecarboxypropane, wherein the derivatives such as the anhydrides and lower alkyl esters of the preceding are also included here.

In particular, the use of an aliphatic diol having at least 6 and not more than 12 carbons and an aliphatic dicarboxylic acid having at least 6 and not more than 12 carbons as the monomer constituent of the crystalline polyester resin is more preferred from the standpoint of bringing about coexistence of the low-temperature fixability and blocking resistance at higher levels:

In the present invention, the crystalline polyester resin preferably has a molecular chain terminal at which at least one aliphatic compound selected from the group consisting of aliphatic monocarboxylic acids having at least 10 and not more than 20 (more preferably at least 12 and not more than 18) carbons and aliphatic monoalcohols having at least 10 and not more than 20 (more preferably at least 12 and not more than 18) carbons is condensed.

The blocking resistance of the toner is improved through the condensation of an aliphatic compound in molecular chain terminal position on the crystalline polyester resin. Based on this, it is thought that, due to the bonding of the aliphatic compound in terminal position, the crystallization rate of the crystalline polyester resin is increased and it solidifies in a more microfinely dispersed state in the cooling step that follows melt-kneading.

With regard to a crystalline segment, generally a crystal grows after a crystal nucleus has formed. In the present invention, due to the bonding of an aliphatic compound in molecular chain terminal position on the crystalline polyester resin, the molecular chain terminal aliphatic compound can promote the crystal growth of segments (referred to as a segment a in the following) that can form a crystalline structure, and the crystallization rate of the crystalline polyester resin can then be enhanced.

The aliphatic compound should be a compound having a faster crystallization rate than the segment a, but is not otherwise particularly limited. However, from the standpoint of a fast crystallization rate, preferably it is a compound that contains a hydrocarbon segment as the main chain and that has at least one functional group that can react with the molecular chain terminal of the crystalline polyester resin. It is more preferably a compound that has a straight-chain configuration for the hydrocarbon segment and that has a single functional group that reacts with the molecular chain terminal of the crystalline polyester resin.

Having the number of carbons in the aliphatic compound be at least a prescribed number is also preferred from the following standpoints: the aliphatic compound assumes a high crystallinity, and in addition it undergoes molecular motion more readily than the segment a of the crystalline polyester resin and the crystallization rate for the aliphatic compound can be increased.

Viewed from the standpoint of raising the crystallization rate, the content of the aliphatic compound, per 100 mol parts of the starting monomer for the crystalline polyester resin, is more preferably at least 0.1 mol parts and not more than 10.0 mol parts and still more preferably at least 0.2 mol parts and not more than 7.0 mol parts.

When this range is observed, the compatibility between the crystalline polyester resin and amorphous polyester resin can be suitably adjusted and an excellent low-temperature fixability is obtained.

Aliphatic monocarboxylic acids having at least 10 and not more than 20 carbons can be exemplified by capric acid (decanoic acid), undecanoic acid, lauric acid (dodecanoic acid), tridecanoic acid, myristic acid (tetradecanoic acid), pentadecanoic acid, palmitic acid (hexadecanoic acid), margaric acid (heptadecanoic acid), stearic acid (octadecanoic acid), nonadecanoic acid, and arachidic acid (eicosanoic acid).

Aliphatic monoalcohols having at least 10 and not more than 20 carbons can be exemplified by decanol, undecanol, lauryl alcohol (dodecanol), tridecanol, myristyl alcohol (tetradecanol), pentadecanol, palmityl alcohol (hexadecanol), margaryl alcohol (heptadecanol), stearyl alcohol (octadecanol), nonadecanol, and arachidyl alcohol (eicosanol).

The occurrence of bonding by the aliphatic compound with the crystalline polyester resin can be determined by analysis as follows.

A sample solution is prepared by exactly weighing out 2 mg of the sample and dissolving it by adding 2 mL of chloroform. The crystalline polyester resin is used as the resin sample, but the toner containing the crystalline polyester resin may be used instead as the sample when acquisition of the crystalline polyester resin is problematic. 20 mg of 2,5-dihydroxybenzoic acid (DHBA) is then exactly weighed out and dissolved by the addition of 1 mL of chloroform to prepare a matrix solution. 3 mg of sodium trifluoroacetate acid (NaTFA) is also exactly weighed out and is dissolved by the addition of 1 mL of acetone to prepare the ionization assistant solution.

25 μL of the thusly prepared sample solution, 50 μL of the matrix solution, and 5 μL of the ionization assistant solution are mixed and this is dripped onto the MALDI analysis sample plate and dried to make the measurement sample.

A mass spectrum is obtained using a MALDI-TOFMS (Reflex III, Bruker Daltonics) as the analytical instrument. The presence/absence of peaks corresponding to a composition in which the aliphatic compound is bonded at a molecular terminal is determined by assigning, in the obtained mass spectrum, the individual peaks in the oligomer range (m/Z not more than 2,000).

<Hydrocarbon Wax>

The hydrocarbon wax used in the toner of the present invention should have a polarity close to that of the polypropylene fraction of the aforementioned wax dispersing agent and should be mutually compatible, but is not otherwise particularly limited.

This hydrocarbon wax can be exemplified by low molecular weight alkylene polymers provided by the radical polymerization of an alkylene under high pressures or provided by polymerization at low pressures using a Ziegler catalyst or metallocene catalyst; alkylene polymers obtained by the pyrolysis of high molecular weight alkylene polymer; and synthetic hydrocarbon waxes obtained from the residual distillation fraction of hydrocarbon obtained by the Arge method from a synthesis gas containing carbon monoxide and hydrogen, and also the synthetic hydrocarbon waxes obtained by the hydrogenation of the former synthetic hydrocarbon waxes.

In addition, the use is more preferred of materials provided by the fractionation of hydrocarbon waxes by a press sweating method, solvent method, use of vacuum distillation, or a fractional crystallization technique. The following are preferred examples of the hydrocarbon source because they are saturated long linear hydrocarbons having few and short branches: hydrocarbon synthesized by the reaction of carbon monoxide and hydrogen using a metal oxide catalyst (frequently a multi-element system that is a binary or higher system) [for example, hydrocarbon compounds synthesized by the Synthol method or Hydrocol method (use of a fluidized catalyst bed)]; hydrocarbon having up to about several hundred carbons, obtained by the Arge method, which produces large amounts of waxy hydrocarbon (use of a fixed catalyst bed); and hydrocarbon provided by the polymerization of an alkylene, e.g., ethylene, using a Ziegler catalyst.

In particular, wax synthesized by a method that does not depend on alkylene polymerization is also preferred for its molecular weight distribution. Paraffin waxes are also preferably used.

Viewed in terms of bringing about an improved low-temperature fixability and hot offset resistance, hydrocarbon waxes such as paraffin waxes and Fischer-Tropsch waxes are also favorable examples.

The content of the hydrocarbon wax in the present invention is preferably at least 1.0 mass part and not more than 20.0 mass parts per 100 mass parts of the binder resin.

The peak temperature of the maximum endothermic peak for the hydrocarbon wax in the heat absorption curve during temperature ramp up in measurement with a differential scanning calorimetric (DSC) instrument is preferably at least 45° C. and not more than 140° C. This is preferred because the blocking resistance and hot offset resistance of the toner can coexist in good balance when the peak temperature of the maximum endothermic peak of the hydrocarbon wax is in the indicated range.

<Colorant>

The following are examples of the colorant that can be incorporated in the toner.

Black colorants can be exemplified by carbon black and by black colorants provided by color mixing using a yellow colorant, a magenta colorant and a cyan colorant to obtain a black color. A pigment may be used by itself as the colorant, but the enhanced sharpness provided by using a dye in combination with pigment is more preferred from the standpoint of the image quality of the full-color image.

Pigments for magenta toners can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; and C. I. Vat Red 1, 2, 10, 13, 15, 23, 29, and 35.

Dyes for magenta toners can be exemplified by the following: oil-soluble dyes such as C. I. Solvent Red 1, 3, 8, 23, 24, 25, 27, 30, 49, 81, 82, 83, 84, 100, 109, and 121, C. I. Disperse Red 9, C. I. Solvent Violet 8, 13, 14, 21, and 27, and C. I. Disperse Violet 1; and basic dyes such as C I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28.

Pigments for cyan toners can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which from 1 to 5 phthalimidomethyl groups have been substituted in the phthalocyanine skeleton.

C. I. Solvent Blue 70 is an example of a dye for cyan toners.

Pigments for yellow toners can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

C. I. Solvent Yellow 162 is an example of a dye for yellow toners.

The colorant content is preferably at least 0.1 mass parts and not more than 30.0 mass parts per 100 mass parts of the binder resin.

<Charge Control Agent>

A charge control agent can also be incorporated in the toner on an optional basis. The known charge control agents can be used as the charge control agent incorporated in the toner, but a colorless metal compound of an aromatic carboxylic acid that can provide a fast charging speed for the toner and that can stably maintain a constant amount of charge is preferred.

Negative-type charge control agents can be exemplified by metal salicylate compounds, metal naphthoate compounds, metal dicarboxylate compounds, polymer compounds that have a sulfonic acid or carboxylic acid in side chain position, polymer compounds that have a sulfonate salt or sulfonate ester in side chain position, polymer compounds that have a carboxylate salt or carboxylate ester in side chain position, boron compounds, urea compounds, silicon compounds, and calixarene.

Positive-type charge control agents can be exemplified by quaternary ammonium salts, polymer compounds having these quaternary ammonium salts in side chain position, guanidine compounds, and imidazole compounds.

The charge control agent may be internally added or externally added to the toner particle. The content of the charge control agent is preferably at least 0.2 mass parts and not more than 10.0 mass parts per 100 mass parts of the binder resin.

<Inorganic Fine Particles>

Inorganic fine particles can also be contained in the toner of the present invention on an optional basis.

The inorganic fine particles may be internally added to the toner particle or may be mixed with the toner particle as an external additive.

The external additive is preferably an inorganic fine particle such as silica, titanium oxide, or aluminum oxide. The inorganic fine particle is preferably hydrophobed using a hydrophobic agent such as a silane compound, silicone oil, or their mixture.

To improve the flowability, the external additive is preferably an inorganic fine particle having specific surface area of at least 50 $m^2/g$ and not more than 400 $m^2/g$; for a durable stabilization, the external additive is preferably an inorganic fine particle having a specific surface area of at least 10 $m^2/g$ and not more than 50 $m^2/g$. Inorganic fine particles with specific surface areas in the indicated ranges may be used in combination in order to bring about an enhanced flowability and a durable stabilization at the same time.

The external additive is preferably used at least 0.1 mass parts and not more than 10.0 mass parts per 100 mass parts of the toner particle. A known mixer such as a Henschel mixer can be used to mix the toner particle and the external additive.

<Developer>

The toner of the present invention can be used as a single-component developer, but, in order to bring about greater improvements in the dot reproducibility, is preferably mixed with a magnetic carrier and used as a two-component developer. This is also preferred from the standpoint of obtaining a stable image on a long-term basis.

The generally known magnetic carriers can be used as the magnetic carrier here, such as surface-oxidized iron powder or unoxidized iron powder; particles of metal such as iron, lithium, calcium, magnesium, nickel, copper, zinc, cobalt, manganese, chromium, and rare earths, and alloy particles and oxide particles of the preceding; magnetic bodies such as ferrite and so forth; and also resin carriers in which a magnetic body is dispersed (known as resin carriers), which contain a magnetic body and a binder resin that maintains this magnetic body in a dispersed state.

With regard to the mixing ratio with the magnetic carrier when the toner of the present invention is used mixed with a magnetic carrier as a two-component developer, at least 2 mass % and not more than 15 mass % is preferred for the toner concentration in the two-component developer, while at least 4 mass % and not more than 13 mass % is more preferred.

<Production Method>

A procedure for producing the toner by a pulverization method is described for the present invention in the following, but there is no limitation to the following.

The toner production method of the present invention includes the steps of: obtaining a kneaded material by melt-kneading a resin composition that contains a binder resin, a colorant, a hydrocarbon wax, and a wax dispersing agent and optionally materials such as a charge control agent; cooling the kneaded material to obtain a cooled material; pulverizing the cooled material to obtain resin particles; and heat treating the resin particles.

That is, the toner of the present invention is a toner having a toner particle produced through the step of melt-kneading a resin composition containing a binder resin, colorant, hydrocarbon wax, and wax dispersing agent, cooling the obtained kneaded material, pulverizing the obtained cooled material, and heat treating the obtained resin particles.

(1) The binder resin, colorant, hydrocarbon wax, and wax dispersing agent that are the materials constituting the toner particle under consideration are weighed out in prescribed amounts and are blended and mixed to obtain a resin composition.

The mixing apparatus can be exemplified by the double cone mixer, V-mixer, drum mixer, super mixer, Henschel mixer, Nauta mixer, and Mechano Hybrid (Mitsui Mining Co., Ltd.).

(2) The colorant and so forth is dispersed in the binder resin by melt-kneading the resin composition.

A batch kneader such as a pressure kneader or Banbury mixer or a continuous kneader can be used for this melt-kneading step, with single-screw and twin-screw extruders being predominant because they offer the advantage of continuous production. Examples here are the KTK twin-screw extruder (Kobe Steel, Ltd.), TEM twin-screw extruder (Toshiba Machine Co., Ltd.), PCM kneader (Ikegai Ironworks Corp.), Twin Screw Extruder (KCK), Co-Kneader (Buss), and Kneadex (Mitsui Mining Co., Ltd.).

(3) The kneaded material provided by melt-kneading is cooled with, for example, water, by rolling with, for example, a two-roll mill.

(4) The cooled material is pulverized by the following means to a desired particle diameter to obtain resin particles.

For example, a coarse pulverization may be carried out using a pulverizer such as a crusher, hammer mill, or feather mill, followed by a fine pulverization with a fine pulverizer, for example, the Kryptron System (Kawasaki Heavy Industries, Ltd.), Super Rotor (Nisshin Engineering Inc.), or Turbo Mill (Turbo Kogyo Co., Ltd.) or using an air jet system.

Classification may then be carried out as necessary using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

(5) A heat treatment is carried out on the resin particles.

There are no particular limitations on this heat treatment step as long as it carries out the treatment of the resin particles with the application of heat.

Treatment is preferably carried out in the present invention using a hot air current from the standpoint of shape uniformity and resin particle coalescence during the heat treatment.

A specific example is provided in the following of a method for executing a heat treatment on the resin particle using the heat treatment apparatus shown in FIG. 1.

Resin particles metered and fed by a starting material metering and feed means 1 are introduced, by a compressed gas adjusted by a compressed gas flow rate adjustment means 2, into an introduction tube 3 that is disposed on the vertical line of a starting material feed means. The resin particles that have passed through the introduction tube 3 are uniformly dispersed by a conical projection member 4 that is disposed at the center of the starting material feed means and are introduced into an 8-direction feed tube 5 that extends radially and are introduced into a treatment compartment 6 in which the heat treatment is performed.

At this point, the flow of the resin particles fed into the treatment compartment 6 is regulated by regulation means 9 that is disposed within the treatment compartment 6 in order to regulate the flow of the resin particles. As a result, the resin particles fed into the treatment compartment 6 are heat treated while rotating within the treatment compartment 6 and are thereafter cooled.

The hot air current for carrying out the heat treatment of the introduced resin particles is fed from a hot air current feed means 7 and is distributed by a distribution member 12, and the hot air current is introduced into the treatment compartment 6 having been caused to undergo a spiral rotation by a rotation member 13 for imparting rotation to the hot air current. With regard to its structure, the rotation member 13 for imparting rotation to the hot air current has a plurality of blades, and the rotation of the hot air current can be controlled using their number and angle (11 shows the outlet for the hot air current feed means). The hot air current fed into the treatment compartment 6 has a temperature at the outlet of the hot air current feed means 7 of preferably at least 100° C. and not more than 300° C. and more preferably at least 130° C. and not more than 170° C. When the temperature at the outlet of the hot air current feed means 7 is within the indicated range, the particles can be uniformly treated while avoiding the melt adhesion and coalescence of the particles caused by excessive heating of the resin particles.

The hot air current is fed from the hot air current feed means 7. In addition, the heat-treated resin particles provided by the heat treatment are cooled by a cold air current fed from a cold air current feed means 8. The temperature of the cold air current fed from the cold air current feed means 8 is preferably at least −20° C. and not more than 30° C. When the temperature of the cold air current is in the indicated range, the heat-treated resin particles can be efficiently cooled and melt adhesion and coalescence of the heat-treated resin particles can be avoided without impairing the uniform heat treatment of the resin particles. The absolute amount of moisture in the cold air current is preferably at least 0.5 $g/m^3$ and not more than 15.0 $g/m^3$.

The cooled heat-treated resin particles are recovered by a recovery means 10 residing at the lower end of the treatment compartment 6. A blower (not shown) is disposed at the end of the recovery means 10 and thereby forms a structure that carries out suction transport.

A powder particle feed port 14 is disposed so the rotational direction of the incoming resin particles is the same direction as the rotational direction of the hot air current, and the recovery means 10 is also disposed tangentially to the outer circumference of the treatment compartment 6 so as to maintain the rotational direction of the rotating resin particles. The cold air current fed from the cold air current feed means 8 is configured to be fed from a horizontal tangential direction from the outer circumference of the apparatus to the circumferential surface within the treatment compartment. The rotational direction of the pre-heat-treatment resin particles fed from the powder particle feed port 14, the rotational direction of the cold air current fed from the cold air current feed means 8, and the rotational direction of the hot air current fed from the hot air current feed means 7 are all the same direction. As a consequence, flow perturbations within the treatment compartment are suppressed, the rotational flow within the apparatus is reinforced, a strong centrifugal force is applied to the resin particles prior to the heat treatment, and the dispersity of the resin particles prior to the heat treatment is enhanced, as a result of which there are few coalesced particles and heat-treated resin particles with a uniform shape can be obtained.

This heat treatment step may be after the aforementioned fine pulverization or after the classification.

The average circularity of the toner in the present invention is preferably at least 0.960 and not more than 1.000 and more preferably at least 0.965 and not more than 1.000. The transfer efficiency of the toner is improved by having the average circularity of the toner be in the indicated range.

<Measurement of the Glass Transition Temperature (Tg) of the Resin>

The glass transition temperature of the resin is measured based on ASTM D 3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 3 mg of the resin is exactly weighed out and this is introduced into an aluminum pan, and the measurement is run using the following conditions and using an empty aluminum pan as reference.

ramp rate: 10° C./minute
measurement start temperature: 30° C.
measurement stop temperature: 180° C.

The measurement is carried out at a ramp rate of 10° C./minute in the temperature range of 30° C. to 180° C. The temperature is raised to 180° C.; this is held for 10 minutes; cooling is then carried out to 30° C.; and reheating is subsequently carried out. The change in the specific heat in the temperature range from 30° C. to 100° C. is obtained in this second heating process. When this is done, the glass transition temperature (Tg) of the resin is the intersection between the differential heat curve and the line for the midpoint of the baselines for prior to and subsequent to the appearance of the change in the specific heat.

<Measurement of the Melting Point of the Polypropylene, Hydrocarbon Wax, and Crystalline Polyester Resin>

The melting point of the polypropylene and hydrocarbon wax and the melting point of the crystalline polyester resin are measured using the following conditions and a "Q2000" differential scanning calorimeter (TA Instruments).

ramp rate: 10° C./minute
measurement start temperature: 20° C.
measurement stop temperature: 180° C.

Temperature correction in the instrument detection section is performed using the melting points of indium and zinc, and the amount of heat is corrected using the heat of fusion of indium.

Specifically, approximately 3 mg of the sample is exactly weighed out and this is introduced into an aluminum pan and measurement is carried out once. An empty aluminum pan is used for reference.

The peak temperature of the obtained maximum endothermic peak is taken to be the melting point (° C.) in the present invention. In the event that a plurality of peaks are present, the maximum endothermic peak denotes the peak presenting the greatest endothermic quantity.

<Measurement of the Endothermic Quantity (ΔH) Originating with the Wax (Wax Dispersity [F/M] in the Examples)>

Using the method described above for measuring the melting point, the endothermic quantity (ΔH) of the maximum endothermic peak originating with the wax is measured in the examples for the resin particles after classification in the classification step and for the powder on the fine particle side separated and recovered from the resin particles. Using M for the ΔH of the resin particles and F for the ΔH of the powder on the fine particle side, the wax dispersity is evaluated through the value (F/M) yielded by dividing F by M.

Here, when the wax-originating maximum endothermic peak does not overlap with an endothermic peak originating with other than the wax, the endothermic quantity of the obtained maximum endothermic peak as such is treated as the endothermic quantity of the maximum endothermic peak originating with the wax.

When, on the other hand, the maximum endothermic peak originating with the wax overlaps with an endothermic peak originating with other than the wax, the endothermic quantity originating with other than the wax is subtracted from the obtained endothermic quantity of the maximum endothermic peak.

The endothermic quantity (ΔH) of the maximum endothermic peak is determined by calculation from the peak area using the analytic software provided with the instrument.

<Measurement of the Weight-Average Molecular Weight (Mw)>

The weight-average molecular weight is measured as follows using gel permeation chromatography (GPC).

First, the sample is dissolved in tetrahydrofuran (THF) over 24 hours at room temperature. The obtained solution is filtered across a solvent-resistant membrane filter "Sample Pretreatment Cartridge" (Tosoh Corporation) with a pore diameter of 0.2 μm to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)
columns: 7-column train of Shodex KF-801, 802, 803, 804, 805, 806, and 807 (Showa Denko K.K.)
eluent: tetrahydrofuran (THF)
flow rate: 1.0 mL/minute
oven temperature: 40.0° C.
sample injection amount: 0.10 mL A calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, and A-500", Tosoh Corporation) is used to determine the molecular weight of the sample.

<Measurement of the Softening Point (Tm)>

The softening point of, e.g., the resin, is measured according to the manual provided with the instrument using a constant-load extrusion-type capillary rheometer, i.e., the "Flowtester CFT-500D Flow Property Evaluation Instrument" (Shimadzu Corporation).

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature can be obtained from this.

In the present invention, the softening point is taken to be the "melting temperature by the ½ method" as described in the manual provided with the "Flowtester CFT-500D Flow Property Evaluation Instrument".

The melting temperature by the ½ method is determined as follows.

First, ½ of the difference between Smax, which is the piston stroke at the completion of outflow, and Smin, which is the piston stroke at the start of outflow, is determined (this is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./minute
piston cross section area: 1.000 $cm^2$
test load (piston load): 10.0 kgf (0.9807 MPa)
preheating time: 300 seconds
diameter of die orifice: 1.0 mm
die length: 1.0 mm <Measurement of the Weight-Average Particle Diameter (D4) of the Toner>

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.) for setting the measurement conditions and analyzing the measurement data, the weight-average particle diameter (D4) of the toner is determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated, software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set at least 2 μm and not more than 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Measurement of the Average Circularity>

The average circularity of the toner is measured with an "FPIA-3000" (Sysmex Corporation), a flow-type particle image analyzer, using the measurement and analysis conditions from the calibration process.

The specific measurement procedure is as follows.

First, approximately 20 mL of deionized water from which the solid impurities and so forth have previously been removed is placed in a glass container. To this is added as a dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W ("VS-150" (Velvo-Clear Co., Ltd.)); prescribed amount of deionized water is introduced into the water tank and approximately 2 mL of the aforementioned Contaminon N is also added to the water tank.

The aforementioned flow-type particle image analyzer fitted with a standard objective lens (10×) is used for the measurement, and Particle Sheath "PSE-900A" (Sysmex Corporation) is used for the sheath solution. The dispersion prepared according to the procedure described above is introduced into this flow-type particle image analyzer and 3,000 of the toner are measured according to total count mode in HPF measurement mode.

The average circularity of the toner is determined with the binarization threshold value during particle analysis set at 85% and the analyzed particle diameter limited to a circle-equivalent diameter of at least 1.985 μm and less than 39.69 μm.

For this measurement, automatic focal point adjustment is performed prior to the start of the measurement using reference latex particles (a dilution with deionized water of "RESEARCH AND TEST PARTICLES Latex Microsphere Suspensions 5200A" from Duke. Scientific Corporation). After this, focal point adjustment is preferably performed every two hours after the start of measurement.

In the examples, the flow-type particle image analyzer used had been calibrated by the Sysmex Corporation and had been issued a calibration certificate by the Sysmex Corporation. The measurements were carried out under the same measurement and analysis conditions as when the calibration certificate was received, except that the analyzed particle diameter was limited to a circle-equivalent diameter of at least 1.985 μm and less than 39.69 μm.

EXAMPLES

The present invention is more specifically described by the following production examples and working examples; however, these in no way limit the present invention. Unless specifically indicated otherwise, the number of parts and the % in the following blends are on a mass basis in all instances.

Polypropylene 1 Production Example 4,000 mL of n-heptane was introduced into a heat-dried 10-L autoclave, and, after degassing, 0.2 MPa of hydrogen was introduced. Propylene was then introduced and the temperature and pressure were raised to polymerization temperature of 90° C. and a total pressure of 0.8 MPa.

To this was added 5 mmol of triisobutylaluminum, micromol of dimethylanilinium tetrakispentafluorophenylborate, and 1 micromol of (1,2'-dimethylsilylene)(2,1'-dimethylsilylene)bis(3-trimethylsilylmethylindenyl)zirconium dichloride, and polymerization was carried out for 50 minutes.

After the completion of the polymerization reaction, the reaction product was dried under reduced pressure to obtain polypropylene 1 as a propylene polymer. The properties of polypropylene 1 are given in Table 1.

Polypropylenes 2 to 5 Production Example

Polypropylenes 2 to 5 were produced proceeding as in the Polypropylene 1 Production Example, except that control was carried out to obtain the prescribed properties through adjustment of the amount of catalyst, polymerization temperature, and reaction time.

TABLE 1

| hydrocarbon | melting point (° C.) | softening point (Tm) (° C.) | weight-average molecular weight (Mw) |
|---|---|---|---|
| polypropylene 1 | 68 | 80 | $4.8 \times 10^4$ |
| polypropylene 2 | 72 | 86 | $5.5 \times 10^4$ |
| polypropylene 3 | 80 | 97 | $6.4 \times 10^4$ |
| polypropylene 4 | 88 | 105 | $8.8 \times 10^4$ |
| polypropylene 5 | 95 | 115 | $10.5 \times 10^4$ |
| Fischer-Tropsch wax 1 | 91 | — | — |
| Fischer-Tropsch wax 2 | 104 | — | — |

Wax Dispersing Agent 1 Production Example

Preparation was carried out using the starting materials and blending ratios (mass parts) indicated in Table 2.

First, 10 mass parts of polypropylene 3 (PP3) was introduced into a four-neck flask fitted with a stirring blade-equipped stirring rod, nitrogen introduction line, thermometer, and condenser and the temperature was raised to 160° C. while introducing nitrogen.

Then, 70 mass parts of styrene (St), 10 mass parts of n-butyl acrylate (BA), 10 mass parts of cyclohexyl methacrylate (CHMA), and 1 mass parts of di-t-butyl peroxide were added dropwise over 5 hours, and, after the completion of addition, distillation under reduced pressure was carried out for 1 hour to obtain wax dispersing agent 1. The properties of wax dispersing agent 1 are given in Table 2.

Through analysis of the molecular weight distribution using gel permeation chromatography (GPC), wax dispersing agent 1 was confirmed to be a polymer of a styrene-acrylic polymer graft polymerized to polypropylene.

Wax Dispersing Agents 2 to 12 Production Example

Wax dispersing agents 2 to 12 were obtained proceeding as in the Wax Dispersing Agent 1 Production Example, except that the starting materials and blending ratios (mass parts) indicated in Table 2 were used with adjustment to obtain the prescribed softening point (Tm) by appropriate adjustment of the reaction time and amount of di-t-butyl peroxide. The properties of wax dispersing agents 2 to 12 are given in Table 2.

Through analysis of the molecular weight distribution using gel permeation chromatography (GPC), wax dispersing agents 2 to 12 were confirmed to be polymers of a styrene-acrylic polymer graft polymerized to polypropylene or Fischer-Tropsch wax.

TABLE 2

| wax dispersing agent | styrene-acrylic polymer part/ hydrocarbon part | blending ratio (mass parts) | softening point (Tm) (° C.) |
|---|---|---|---|
| dispersing agent 1 | St-BA-CHMA/ PP3 | 70-10-10/10 | 120 |
| dispersing agent 2 | St-2EHA-CHMA/ PP3 | 75-10-5/10 | 119 |
| dispersing agent 3 | St-BA-CHMA/ PP2 | 70-10-10/10 | 118 |
| dispersing agent 4 | St-BA-CHMA/ PP4 | 70-10-10/10 | 125 |
| dispersing agent 5 | St-BA-cyclohexyl acrylate/ PP3 | 70-10-10/10 | 115 |
| dispersing agent 6 | St-BA-cyclopentyl methacrylate/ PP3 | 70-10-10/10 | 114 |
| dispersing agent 7 | St-BA-cyclopropyl methacrylate/ PP3 | 70-10-10/10 | 114 |
| dispersing agent 8 | St-BA/ PP3 | 75-15/10 | 116 |
| dispersing agent 9 | St-BA-CHMA/ Fischer-Tropsch wax 1 | 70-10-10/10 | 109 |
| dispersing agent 10 | St-BA-CHMA/ Fischer-Tropsch wax 2 | 70-10-10/10 | 112 |
| dispersing agent 11 | St-BA-CHMA/PP1 | 70-10-10/10 | 115 |
| dispersing agent 12 | St-BA-CHMA/PP5 | 70-10-10/10 | 127 |

The abbreviations used in Table 2 refer to the following.

St: styrene
BA: n-butyl acrylate
2EHA: 2-ethylhexyl acrylate
CHMA: cyclohexyl methacrylate
PP1: polypropylene 1
PP2: polypropylene 2
PP3: polypropylene 3
PP4: polypropylene 4
PP5: polypropylene 5

Crystalline Polyester Resin 1 Production Example

The starting monomer given in Table 3 and tin(II) octylate (0.5 mass parts per 100 mass parts of the total amount of starting monomer) were introduced into a reaction vessel fitted with a condenser, stirrer, nitrogen introduction line, and thermocouple. While stirring under a nitrogen gas atmosphere, the temperature was gradually raised to 160° C. and a reaction was then run for 5 hours at 160° C. while stirring.

The pressure in the reaction vessel was subsequently dropped to 8.3 kPa and the temperature was raised to 200° C. and a reaction was run for 4 hours (first reaction step).

The pressure in the reaction vessel was then gradually released and returned to normal pressure; 5.0 mol parts octadecanoic acid was added per 100 mol parts of the total amount of the starting carboxylic acid component and alcohol component; and a reaction was run for 2 hours at 200° C. under normal pressure. The interior of the reaction vessel was then again depressurized to 5 kPa or less and a reaction was run for 3 hours at 200° C. to obtain crystalline polyester resin 1 (second reaction step).

The properties of the obtained crystalline polyester resin 1 are given in Table 3.

Crystalline Polyester Resins 2 to 5 Production Example

Crystalline polyester resins 2 to 5 were obtained proceeding as in the Crystalline Polyester Resin 1 Production Example, except that the respective monomer amounts were changed such that the molar ratios for the alcohol component and/or carboxylic acid component in the first reaction step as shown in Table 3 were obtained and also the molar ratio for the aliphatic compound in the second reaction step was changed as shown in Table 3.

The properties of the obtained crystalline polyester resins 2 to 5 are given in Table 3.

TABLE 3

| | | | | crystalline polyester resin 1 | crystalline polyester resin 2 | crystalline polyester resin 3 | crystalline polyester resin 4 | crystalline polyester resin 5 | crystalline polyester resin 6 |
|---|---|---|---|---|---|---|---|---|---|
| first reaction step | carboxylic acid component | fumaric acid | (mol parts) | — | — | — | — | — | 50 |
| | | sebacic acid | (mol parts) | — | — | — | — | 50 | — |
| | | dodecane dioic acid | (mol parts) | 50 | 50 | 50 | 50 | — | — |
| | alcohol component | 1,6-hexane diol | (mol parts) | 50 | 50 | 50 | 50 | — | 50 |
| | | 1,9-nonane diol | (mol parts) | — | — | — | | 50 | — |
| second reaction step | octadecanoic acid | | (mol parts) | 5 | — | — | — | — | — |
| | dodecanoic acid | | (mol parts) | — | 5 | — | — | — | — |
| | caprylic acid | | (mol parts) | — | — | 5 | — | — | — |
| peak temperature (T1) of the maximum endothermic peak of the crystalline polyester resin as measured with a differential scanning calorimeter (DSC) | | | (° C.) | 72 | 72 | 71 | 72 | 68 | 110 |

Amorphous Polyester Resin A Production Example

A 5-L four-neck flask fitted with a nitrogen introduction line, condenser, stirrer, and thermocouple was substituted with nitrogen; the starting monomer as shown in Table 4 and tin(II) octylate were subsequently introduced; and the temperature was raised to 180° C. and a reaction was then run for 10 hours. The reaction was run for an additional 5 hours at 15 mmHg (first reaction step), followed by the second reaction step of adding trimellitic anhydride as in Table 4 and reacting for 3 hours at 180° C. to obtain amorphous polyester resin A. The properties of the resin are given in Table 4.

Amorphous Polyester Resin B Production Example

Amorphous polyester resin B was produced proceeding as in the Amorphous Polyester Resin A Production Example, except that the starting materials shown in Table 4 were used and the reaction in the second reaction step was stopped once it had been confirmed that the softening point had reached the temperature given in Table 4. The properties of the amorphous polyester resins are given in Table 4.

TABLE 4

| | alcohol compound | | | carboxylic acid component | | | | properties | |
|---|---|---|---|---|---|---|---|---|---|
| | first reaction step monomer | | | first reaction step monomer | | second reaction step monomer | | glass transition | softening |
| amorphous resin | type | average number of moles of addition | mol parts | type | mol parts | type | mol parts | temperature Tg [° C.] | point Tm [° C.] |
| A | BPA-PO | 2.7 | 60 | TPA | 40 | TMA anhydride | 0.04 | 50 | 82 |
| B | BPA-PO<br>BPA-EO | 2.7<br>2.0 | 57<br>3 | TPA | 40 | TMA anhydride | 0.04 | 60 | 135 |

The abbreviations used in Table 4 refer to the following.

BPA-PO: propylene oxide adduct on bisphenol A

BPA-EO: ethylene oxide adduct on bisphenol A

TPA: terephthalic acid

TMA anhydride: trimellitic anhydride

Resin C Production Example 40 mass parts of styrene, 10 mass parts of cyclohexyl methacrylate, and 20 mass parts of n-butyl acrylate were added to a four-neck flask having a reflux condenser, thermometer, nitrogen introduction line, and stirrer. 30 mass parts of toluene, 30 mass parts of methyl ethyl ketone, and 2.0 mass parts of azobisisovaleronitrile were also added. The resulting mixture was reacted under a nitrogen current by holding for 10 hours at 70° C., and hexane was poured into the resulting reaction product to precipitate the resin. After separation of the precipitate by filtration, it was repeatedly washed and then vacuum dried to obtain resin C (glass transition temperature (Tg): 84° C., weight-average molecular weight (Mw): $1.5\times10^4$).

Toner 1 Production Example

| | |
|---|---|
| amorphous polyester resin A | 62.5 mass parts |
| amorphous polyester resin B | 30.0 mass parts |
| wax dispersing agent 1 | 5.0 mass parts |
| crystalline polyester resin 1 | 15.0 mass parts |
| hydrocarbon wax (HNP51, Nippon Seiro Co., Ltd.) | 5.0 mass parts |
| Nipex35 carbon black (Degussa AG) | 9.0 mass parts |
| aluminum 3,5-di-t-butylsalicylate compound (Bontron E88, Orient Chemical Industries Co., Ltd.) | 0.3 mass parts |

These materials were mixed using a Henschel mixer (Model FM-75, Mitsui Miike Chemical Engineering Machinery Co., Ltd.) at a rotation rate of 20 $s^{-1}$ for a rotation time of 5 minutes, followed by melt-kneading with a twin-screw kneader (Model PCM-30, Ikegai Corp) set at a temperature of 145° C.

The obtained kneaded material was cooled and was coarsely pulverized to 1 mm or less using a hammer mill to obtain a coarsely pulverized material.

The resulting coarsely pulverized material was finely pulverized using a mechanical pulverizer (T-250, Turbo Kogyo Co., Ltd.).

Classification was additionally performed using a Faculty F-300 (Hosokawa Micron Corporation) to obtain resin particle 1.

The operating conditions were a classification rotor rotation rate of 130 $s^{-1}$ and a dispersing rotor rotation rate of 120 $s^{-1}$. In addition, the powder on the fine particle side separated from the resin particle 1 in the classification step was recovered separately and submitted to analysis.

The obtained resin particle 1 was subjected to heat treatment using the heat treatment apparatus shown in FIG. 1 to obtain toner particle 1.

The operating conditions were as follows: feed rate of 5 kg/hr, hot air current temperature of 170° C., hot air current flow rate of 6 $m^3$/minute, cold air current temperature of −5° C., cold air current flow rate of 4 $m^3$/minute, blower output of 20 $m^3$/minute, and injection air flow rate of 1 $m^3$/minute.

The following were mixed in a Henschel mixer (Model FM-75, Mitsui Miike Chemical Engineering Machinery Co., Ltd.) at a rotation rate of 30 $s^{-1}$ and a rotation time of 10 minutes to obtain a toner 1: 100 mass parts of toner particle 1, 1.0 mass part of hydrophobic silica fine particles (BET: 200 $m^2$/g) that had been surface-treated with hexamethyldisilazane, and 1.0 mass part of titanium oxide fine particles (BET: 80 $m^2$/g) that had been surface-treated with isobutyltrimethoxysilane.

The weight-average particle diameter (D4) of toner 1 was 6.0 μm and its average circularity was 0.965. The properties of the toner are given in Table 5.

Toners 2 to 22 Production Example

Toners 2 to 22 were obtained proceeding as in the Toner 1 Production Example, except that production was carried out by blending the starting materials indicated in Table 5 in accordance with Table 5.

TABLE 5

| toner No. | amorphous polyester resin type | amorphous polyester resin number of parts of addition | amorphous polyester resin type | amorphous polyester resin number of parts of addition | crystalline polyester resin type | crystalline polyester resin number of parts of addition | colorant type | colorant number of parts of addition | other type | other number of parts of addition |
|---|---|---|---|---|---|---|---|---|---|---|
| 1 | A | 62.5 | B | 30.0 | 1 | 5.0 | Nipex35 | 9.0 | — | — |
| 2 | ↑ | ↑ | ↑ | ↑ | ↑ | 3.0 | ↑ | ↑ | — | — |
| 3 | ↑ | ↑ | ↑ | ↑ | 2 | 5.0 | ↑ | ↑ | — | — |
| 4 | ↑ | ↑ | ↑ | ↑ | ↑ | 5.0 | ↑ | ↑ | — | — |
| 5 | ↑ | ↑ | ↑ | ↑ | 3 | 5.0 | ↑ | ↑ | — | — |
| 6 | ↑ | ↑ | ↑ | ↑ | 4 | 10.0 | ↑ | ↑ | — | — |
| 7 | ↑ | ↑ | ↑ | ↑ | 5 | 10.0 | ↑ | ↑ | — | — |
| 8 | ↑ | ↑ | ↑ | ↑ | ↑ | 17.0 | ↑ | ↑ | — | — |
| 9 | ↑ | ↑ | ↑ | ↑ | 6 | 17.0 | ↑ | ↑ | — | — |
| 10 | ↑ | ↑ | ↑ | ↑ | — | — | ↑ | ↑ | — | — |
| 11 | ↑ | ↑ | ↑ | ↑ | — | — | ↑ | ↑ | — | — |
| 12 | ↑ | ↑ | ↑ | ↑ | — | — | ↑ | ↑ | — | — |
| 13 | ↑ | ↑ | ↑ | ↑ | — | — | ↑ | ↑ | — | — |
| 14 | ↑ | ↑ | ↑ | ↑ | — | — | ↑ | ↑ | — | — |
| 15 | ↑ | ↑ | ↑ | ↑ | — | — | ↑ | ↑ | resin C<br>polypropylene 3 | 4.5<br>0.5 |
| 16 | ↑ | ↑ | ↑ | ↑ | — | — | ↑ | ↑ | — | — |
| 17 | ↑ | ↑ | ↑ | ↑ | — | — | ↑ | ↑ | — | — |
| 18 | ↑ | ↑ | ↑ | ↑ | — | — | ↑ | ↑ | — | — |
| 19 | ↑ | ↑ | ↑ | ↑ | — | — | ↑ | ↑ | — | — |
| 20 | ↑ | ↑ | ↑ | ↑ | — | — | ↑ | ↑ | — | — |
| 21 | ↑ | ↑ | ↑ | ↑ | — | — | ↑ | ↑ | — | — |
| 22 | ↑ | ↑ | ↑ | ↑ | — | — | ↑ | ↑ | — | — |

| toner No. | wax dispersing agent type | wax dispersing agent Mp (p) | wax dispersing agent number of parts of addition | hydrocarbon wax type | hydrocarbon wax Mp (w) | hydrocarbon wax number of parts of addition | D4 (μm) | average circularity | formula (1) Mp (p) | formula (2) \| Mp(p) − Mp(w) \| |
|---|---|---|---|---|---|---|---|---|---|---|
| 1 | 1 | 80 | 5.0 | HNP51 | 79 | 5.0 | 6.2 | 0.970 | 80 | 1 |
| 2 | ↑ | 80 | ↑ | FNP0090 | 91 | ↑ | 6.2 | 0.971 | 80 | 11 |
| 3 | 2 | 80 | ↑ | ↑ | 91 | ↑ | 6.2 | 0.970 | 80 | 11 |
| 4 | 3 | 72 | ↑ | HNP51 | 79 | ↑ | 6.2 | 0.970 | 72 | 7 |
| 5 | ↑ | 72 | ↑ | ↑ | 79 | ↑ | 6.2 | 0.970 | 72 | 7 |
| 6 | ↑ | 72 | ↑ | ↑ | 79 | ↑ | 6.2 | 0.970 | 72 | 7 |
| 7 | ↑ | 72 | ↑ | ↑ | 79 | ↑ | 6.2 | 0.970 | 72 | 7 |
| 8 | ↑ | 72 | ↑ | ↑ | 79 | ↑ | 6.2 | 0.970 | 72 | 7 |
| 9 | 4 | 88 | ↑ | ↑ | 79 | ↑ | 6.3 | 0.970 | 88 | 9 |
| 10 | ↑ | 88 | ↑ | ↑ | 79 | ↑ | 6.2 | 0.970 | 88 | 9 |
| 11 | 3 | 72 | ↑ | FNP0090 | 91 | ↑ | 6.2 | 0.970 | 72 | 19 |
| 12 | 5 | 80 | ↑ | ↑ | 91 | ↑ | 6.2 | 0.970 | 80 | 11 |
| 13 | 6 | 80 | ↑ | ↑ | 91 | ↑ | 6.2 | 0.970 | 80 | 11 |
| 14 | 7 | 80 | ↑ | ↑ | 91 | ↑ | 6.2 | 0.971 | 80 | 11 |
| 15 | — | — | — | ↑ | 91 | ↑ | 6.2 | 0.970 | — | — |
| 16 | 8 | 80 | 5 | ↑ | 91 | ↑ | 6.2 | 0.971 | 80 | 11 |
| 17 | 9 | — | ↑ | ↑ | 91 | ↑ | 6.2 | 0.971 | — | — |
| 18 | 10 | — | ↑ | HNP51 | 79 | ↑ | 6.2 | 0.971 | — | — |
| 19 | 11 | 68 | ↑ | ↑ | 79 | ↑ | 6.2 | 0.970 | 68 | 11 |
| 20 | 12 | 95 | ↑ | FNP0090 | 91 | ↑ | 6.2 | 0.970 | 95 | 4 |
| 21 | 1 | 80 | ↑ | 151P | 107 | ↑ | 6.2 | 0.947 | 80 | 27 |
| 22 | 4 | 88 | ↑ | HNP11 | 67 | ↑ | 6.2 | 0.947 | 88 | 21 |

The abbreviations used in Table 5 refer to the following.
FNP0090 is a hydrocarbon wax (supplier: Nippon Seiro Co., Ltd.)
151P is a hydrocarbon wax (supplier: Sanyo Chemical Industries, Ltd.)
HNP11 is a hydrocarbon wax (supplier: Nippon Seiro Co., Ltd.)

Magnetic Core Particle 1 Production Example

Step 1 (Weighing and Mixing Step):

| | |
|---|---|
| $Fe_2O_3$ | 62.7 mass parts |
| $MnCO_3$ | 29.5 mass parts |
| $Mg(OH)_2$ | 6.8 mass parts |
| $SrCO_3$ | 1.0 mass part |

This ferrite starting material was weighed out to provide the indicated compositional ratio for the materials. This was followed by pulverization and mixing for 5 hours with a dry vibrating mill that used stainless steel beads having a diameter of ⅛ inch.

Step 2 (Presintering Step):

The obtained pulverized material was converted into approximately 1 mm-square pellets using a roller compactor. Coarse powder was removed from these pellets using a vibrating screen having an aperture of 3 mm; the fines were then removed using a vibrating screen having an aperture of 0.5 mm; and sintering was thereafter carried out in a burner-type sintering furnace under a nitrogen atmosphere (0.01 volume % oxygen concentration) for 4 hours at a temperature of 1,000° C. to produce a presintered ferrite. The composition of the obtained presintered ferrite is as follows.

$$(MnO)_a(MgO)_b(SrO)_c(Fe_2O_3)_d$$

In the formula, a=0.257, b=0.117, c=0.007, d=0.393

Step 3 (Pulverization Step):

The obtained presintered ferrite was pulverized with a crusher to about 0.3 mm, followed by the addition of 30 mass parts of water per 100 mass parts of the presintered ferrite and pulverization for 1 hour with a wet ball mill using zirconia beads with a diameter of ⅛ inch. The obtained slurry was pulverized for 4 hours with a wet ball mill using alumina beads having a diameter of 1/16 inch to obtain a ferrite slurry (fine pulverizate of the presintered ferrite).

Step 4 (Granulating Step):

1.0 mass part of an ammonium polycarboxylate as a dispersing agent and 2.0 mass parts of polyvinyl alcohol as a binder were added to the ferrite slurry per 100 mass parts of the presintered ferrite, followed by granulation into spherical particles using a spray dryer (manufacturer: Ohkawara Kakohki Co., Ltd.). The particle size of the obtained particles was adjusted followed by heating for 2 hours at 650° C. using a rotary kiln to remove the organics, e.g., the dispersing agent and binder.

Step 5 (Sintering Step):

In order to control the sintering atmosphere, the temperature was raised over 2 hours using an electric furnace from room temperature to a temperature of 1,300° C. under a nitrogen atmosphere (1.00 volume % oxygen concentration), and sintering was then performed for 4 hours at a temperature of 1,150° C. This was followed by reducing the temperature to a temperature of 60° C. over 4 hours, returning to the atmosphere from the nitrogen atmosphere, and removal at a temperature of 40° C. or below.

Step 6 (Classification Step):

The aggregated particles were broken up; the low magnetic force product was removed using a magnetic force classifier; and the coarse particles were removed by sieving on a sieve with an aperture of 250 μm to obtain magnetic core particle 1 having a 50% particle diameter (D50) based on the volumetric distribution of 37.0 μm.

<Coating Resin 1 Preparation>

| | |
|---|---|
| cyclohexyl methacrylate monomer | 26.8 mass % |
| methyl methacrylate monomer | 0.2 mass % |
| methyl methacrylate macromonomer (macromonomer with a weight-average molecular weight of 5,000 having the methacryloyl group at one terminal) | 8.4 mass % |
| toluene | 31.3 mass % |
| methyl ethyl ketone | 31.3 mass % |
| azobisisobutyronitrile | 2.0 mass % |

Of these materials, the cyclohexyl methacrylate monomer, methyl methacrylate monomer, methyl methacrylate macromonomer, toluene, and methyl ethyl ketone were introduced into four-neck separable flask fitted with a reflux condenser, thermometer, nitrogen introduction line, and stirrer and nitrogen gas was introduced in order to replace the interior of the system with nitrogen gas. This was followed by heating to 80° C., the addition of the azobisisobutyronitrile, and polymerization for 5 hours under reflux. Hexane was poured into the obtained reaction product to precipitate the copolymer and the precipitate was separated by filtration and vacuum dried to obtain a coating resin 1.

30 mass parts of the coating resin 1 was then dissolved in 40 mass parts of toluene and 30 mass parts of methyl ethyl ketone to obtain a polymer solution 1 (solids fraction=30 mass %).

<Coating Resin Solution 1 Preparation>

| | |
|---|---|
| polymer solution 1 (resin solids fraction concentration = 30%) | 33.3 mass % |
| toluene | 66.4 mass % |
| carbon black (Regal 330, Cabot Corporation) (primary particle diameter = 25 nm, specific surface area by nitrogen adsorption = 94 $m^2$/g, DBP absorption = 75 mL/100 g) | 0.3 mass % |

were dispersed for 1 hour with a paint shaker using zirconia beads having a diameter of 0.5 mm. The obtained dispersion was filtered Across a 5.0 μm membrane filter to obtain coating resin solution 1.

Magnetic Carrier 1 Production Example (Resin Coating Step):

The magnetic core particle 1 and coating resin solution 1 were introduced into a vacuum-degassing kneader being maintained at normal temperature (the amount of introduction of the coating resin solution 1 was an amount that provided 2.5 mass parts as the resin component per 100 mass parts of the magnetic core particle 1). After the introduction, stirring was performed for 15 minutes at a stirring rate of 30 rpm and the solvent was evaporated by at least a prescribed amount (80 mass %) followed by raising the temperature to 80° C. while mixing under reduced pressure, distilling off the toluene over 2 hours, and cooling. The low magnetic force product was separated from the obtained magnetic carrier using a magnetic force classifier, and the magnetic carrier was then passed through a sieve having an aperture of 70 μm and classified using a wind force classifier to obtain a magnetic carrier 1 having a 50% particle diameter (D50) based on the volumetric distribution of 38.2 μm.

Two-Component Developer 1 Production Example 8.0 mass parts of toner 1 was added to 92.0 mass parts of magnetic carrier 1 and a two-component developer 1 was obtained by mixing with a V-mixer (V-20, Seishin Enterprise Co., Ltd.).

Two-Component Developers 2 to 22 Production Example

Two-component developers 2 to 22 were obtained by carrying out the same procedure as in the Two-Component Developer 1 Production Example, except that the toner was changed as indicated in Table 6.

Example 1

Evaluations were carried out using the two-component developer 1.

The evaluations described below were carried out using a modified imageRUNNER ADVANCE C9075 PRO—which is a digital printer for commercial printing from Canon, Inc.—for the image-forming apparatus, with the two-component developer introduced into the developing device at the cyan station and with the direct-current voltage $V_{DC}$ of the developer-bearing member, the charging voltage $V_D$ for the electrostatic latent image-bearing member, and the laser power adjusted to provide the desired toner laid-on level on the electrostatic latent image-bearing member or the paper. The modifications were changes that enabled the fixation temperature and process speed to be freely set.

The evaluations were performed based on the following evaluation methods, and the results thereof are given in Table 6.

<Evaluation 1: Wax Dispersity (F/M)>

The endothermic quantity (ΔH) of the maximum endothermic peak originating with the wax was measured using the resin particles after classification in the classification step in the Toner 1 Production Example and using the powder on the fine particle side separated and recovered from the resin particles.

Using M for the ΔH of the resin particles and F for the ΔH of the powder on the fine particle side, the wax dispersity was evaluated through the value (F/M) yielded by dividing F by M.

When the wax is not microfinely dispersed and is present in the kneaded material as large domains, the domains form a cleavage interface in the pulverization step and wax domains are liberated from within the resin.

Since the liberated wax is recovered in the classification step as powder on the fine particle side, in the event of a poor wax dispersity, wax that has formed domains is recovered in the powder on the fine particle side.

Due to this, the wax dispersity was evaluated by comparing the endothermic quantities (ΔH) for the maximum endothermic peak originating from the wax for both the resin particles and the powder on the fine particle side and was evaluated using the following criteria.

(Evaluation Criteria)

A F/M is at least 1.00 and less than 1.05 (outstanding)

B: F/M is at least 1.05 and less than 1.10 (excellent)

C: F/M is at least 1.10 and less than 1.20 (good)

D: F/M is at least 1.20 and less than 1.30 (unproblematic level)

E: F/M is at least 1.30 (level unacceptable for the present invention)

<Evaluation 2: Blocking Resistance (Residual Percentage)>

5 g of the toner was introduced into a 100-mL plastic container and this was held for 48 hours in a thermostat that enabled the temperature and humidity to be changed (setting: 55° C., 41% RH), and after this holding the toner aggregation behavior was evaluated.

The evaluation index for the aggregation behavior was the residual percentage of toner that remained after sieving on a mesh with an aperture of 20 μm for 10 seconds at an amplitude of 0.5 mm using a Powder Tester PT-X from Hosokawa Micron Corporation.

(Evaluation Criteria)

A: the residual percentage is less than 2.0% (outstanding)

B: the residual percentage is at least 2.0% and less than 10.0% (good)

C: the residual percentage is at least 10.0% and less than 15.0% (acceptable level for the present invention)

D: the residual percentage is at least 15.0% (level unacceptable for the present invention)

<Evaluation 3: Charging Performance (Charge Retention Ratio)>

The triboelectric charge quantity on the toner and the toner laid-on level were determined by suctioning and collecting the toner on the electrostatic latent image-bearing member using a cylindrical metal tube and a cylindrical filter.

Figure 2:
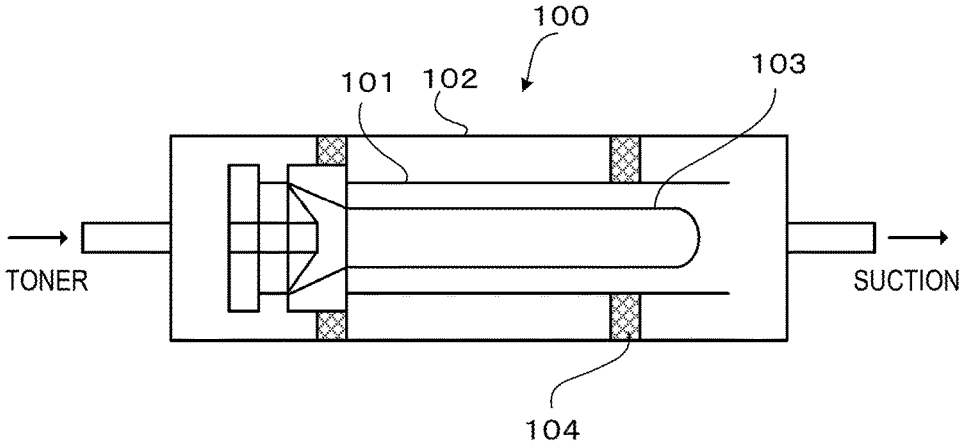
FIG. 2 is a schematic diagram of a Faraday cage.

Specifically, the toner laid-on level and the triboelectric charge quantity on the toner on the electrostatic latent image-bearing member were measured using a Faraday cage as shown in FIG. 2.

The toner on the electrostatic latent image-bearing member is suctioned off with air using a Faraday cage 100 provided with a metal double cylinder of an inner cylinder 101 and an outer cylinder 102 wherein the cylinders have different shaft diameters and are coaxial, and provided within the inner cylinder 101 with a filter 103 for the collection of toner.

The inner cylinder 101 is insulated from the outer cylinder 102 in the Faraday cage 100 by an insulating member 104, and, when toner is collected within the filter, electrostatic induction is produced by the charge Q on the toner. The introduction of charged body of charge Q into the inner cylinder is the same as if a metal cylinder having a charge Q due to electrostatic induction were present. This induced charge was measured with ah electrometer (Keithley 6517A, Keithley Instruments), and the triboelectric charge quantity on the toner was taken to be the charge Q (mC) divided by the mass M (kg) of the toner in the inner cylinder (Q/M).

By measuring the suctioned area S, the toner laid-on level per unit area was obtained by dividing the toner mass M by the suctioned area S ($cm^2$).

The measurement on the toner was carried out by stopping the rotation of the electrostatic latent image-bearing member prior to transfer of the toner layer formed on the electrostatic latent image-bearing member to the intermediate transfer member and directly air suctioning the toner image on the electrostatic latent image-bearing member.

$$\text{toner laid-on level (mg/cm}^2\text{)} = M/S$$

$$\text{toner triboelectric charge quantity (mC/kg)} = Q/M$$

The aforementioned image-forming apparatus was adjusted to provide a toner laid-on level on the electrostatic latent image-bearing member of 0.35 $mg/cm^2$ in a high-temperature, high-humidity environment (32.5° C., 80% RH), and suction and collection were performed using the aforementioned metal cylindrical tube and cylindrical filter. During this procedure, the collected toner mass M and the charge Q passing through the metal cylindrical tube and accumulated in a capacitor were measured, and the charge per unit mass Q/M (mC/kg) was calculated and was used as the charge per unit mass Q/M (mC/kg) on the electrostatic latent image-bearing member (initial evaluation).

After this evaluation (initial evaluation) had been performed, the developing device was removed from the machine and was held for 72 hours in a high-temperature, high-humidity environment (32.5° C., 80% RH). After this holding period, the developing device was remounted in the machine, and the charge per unit mass Q/M on the electrostatic latent image-bearing member was measured at the same direct-current voltage $V_{DC}$ as in the initial evaluation (post-holding evaluation).

Using 100% for the Q/M per unit mass on the electrostatic latent image-bearing member in the initial evaluation described above, the retention ratio for the charge per unit mass Q/M on the electrostatic latent image-bearing member after holding for 72 hours (post-holding evaluation) was calculated (post-holding evaluation/initial evaluation×100) and was scored according to the following criteria.

(Evaluation Criteria)

A: the retention ratio is at least 80% (excellent)

B: the retention ratio is at least 70% and less than 80% (improved)

C: the retention ratio is at least 60% and less than 70% (acceptable level for the present invention)

D: the retention ratio is less than 60% (level unacceptable for the present invention)

<Evaluation 4: Low-Temperature Fixability (Lower Temperature Limit at which Fixing is Possible)>

A developing device filled with the two-component developer 1 was mounted in the cyan station of an imagePRESS C1+ full-color copier from Canon, Inc.; a modification was made to enable image formation with the fixing unit removed; and an unfixed toner image (below, the unfixed image) was formed on the evaluation paper.

GF-C104 (A4: 104 g/cm$^2$, available from Canon Marketing Japan Inc.), a plain paper for color copiers and printers, was used for the evaluation.

Here, the developing conditions were appropriately adjusted to provide a toner laid-on level on the paper for the FFH image (below, the solid region) of 1.2 mg/cm$^2$, and a 2 cm×10 cm unfixed image was formed at a position in the middle of the evaluation paper and 3 cm from the front edge of the A4 longitudinal evaluation paper. The unfixed image was conditioned for 24 hours in a low-humidity, low-temperature environment (15° C./10% RH).

The fixing unit was then removed from an imageRUNNER ADVANCE C9075 PRO, a full-color copier from Canon, Inc., and a fixing test stand was prepared in which the process speed and the temperature of the upper and lower fixing members could be independently controlled.

The evaluation of the fixability was performed in a low-temperature, low-humidity environment (15° C./10% RH) and used the fixing test stand adjusted to process speed of 450 mm/second.

During the actual evaluation, the evaluation was performed by feeding the unfixed image while adjusting the upper belt temperature in the fixing test stand to each 5° C. step in the range from 100° C. to 200° C., and during this the lower belt temperature was fixed at 100° C.

The fixed image that had passed through the fixing unit was rubbed back-and-forth five times with a lens cleaning wipe (Dusper, Ozu Corporation) carrying load of 4.9 kPa, and the fixation temperature was taken to be the point at which the percentage density decline in the image density pre-versus-post-rubbing was 10% or less. Based on the judgment that fixing did not occur when the density decline exceeded 10%, the low-temperature fixation temperature was taken to be the lowest upper belt set temperature at which the percentage decline in the image density did not exceed 10%, and this was evaluated according to the following evaluation criteria.

(Evaluation Criteria)

A: less than 125° C. (excellent)

B: at least 125° C. and less than 140° C. (improved)

C: at least 140° C. and less than 160° C. (acceptable level for the present invention)

D: at least 160° C. (level unacceptable for the present invention)

<Evaluation 5: Image Quality (Tinting Strength)>

A developing device filled with the two-component developer 1 was mounted in the cyan station of an imagePRESS C1+ full-color copier from Canon, Inc.; a modification was made to enable image formation with the fixing unit removed; and an unfixed toner image (below, the unfixed image) was formed on the evaluation paper.

CS680 A4 (A4, 68 g/cm$^2$, available from Canon Marketing Japan Inc.), a plain paper for color copiers and printers, was used for the evaluation, which was carried out in a normal-temperature, normal-humidity environment (23° C., 50% RH). Solid unfixed images were produced in a plurality of types having a toner laid-on level on the paper in the range from 0.2 mg/cm$^2$ to 0.8 mg/cm$^2$.

The fixing unit was then removed from an imageRUNNER ADVANCE C9075 PRO, a full-color copier from Canon, Inc., and a fixing test stand that supported independent control of the process speed and the temperature of the upper and lower fixing members was prepared in a normal-temperature, normal-humidity environment (23° C./50% RH).

The process speed was adjusted to 450 mm/second and the upper belt temperature in the fixing test stand was set, in conformity to each particular toner, using as the proper fixation temperature a, temperature 20° C. higher than the lowest fixation temperature according to the results of the above-described evaluation of the low-temperature fixability.

With the lower belt temperature fixed at 100° C., a fixed solid image was obtained by feed through of the unfixed image. The image density of the resulting fixed image was measured using an X-Rite color reflection densitometer, and the relationship between the amount of toner on the transfer paper and the image density was graphed. The image density for a toner laid-on level on the paper of 0.55 mg/cm$^2$ was read from the graph and the relative tinting strength was evaluated as follows.

(Evaluation Criteria)

A: at least 1.60 (excellent)

B: at least 1.55 and less than 1.60 (improved)

C: at least 1.50 and less than 1.55 (acceptable level for the present invention)

D: less than 1.50 (level unacceptable for the present invention)

Examples 2 to 14 and Comparative Examples 1 to 8

The same evaluations as in Example 1 were carried out using the two-component developers 2 to 22 in Table 6. The evaluation results are given in Table 6.

TABLE 6

| | two-component developer | | evaluation 1 | | evaluation 2 residual percentage | | evaluation 3 initial Q/M | evaluation 3 post-holding Q/M | evaluation 3 retention ratio | | evaluation 4 low-temp fixation temp | | evaluation 5 | |
|---|---|---|---|---|---|---|---|---|---|---|---|---|---|---|
| | No. | toner | F/M | eval | [%] | eval | [mC/kg] | [mC/kg] | [%] | eval | [° C.] | eval | density | eval |
| Example1 | 1 | 1 | 1.00 | A | 1.6 | A | 35.1 | 31.0 | 88 | A | 120 | A | 1.63 | A |
| Example2 | 2 | 2 | 1.07 | B | 1.5 | A | 36.1 | 30.5 | 84 | A | 125 | B | 1.61 | A |
| Example3 | 3 | 3 | 1.07 | B | 1.8 | A | 35.0 | 29.8 | 85 | A | 120 | A | 1.61 | A |

TABLE 6-continued

| | two-component developer | | evaluation 1 | | evaluation 2 residual percentage | | evaluation 3 initial Q/M | post-holding Q/M | retention ratio | | evaluation 4 low-temp fixation temp | | evaluation 5 | |
|---|---|---|---|---|---|---|---|---|---|---|---|---|---|---|
| | No. | toner | F/M | eval | [%] | eval | [mC/kg] | [mC/kg] | [%] | eval | [° C.] | eval | density | eval |
| Example4 | 4 | 4 | 1.04 | A | 1.9 | A | 35.1 | 30.2 | 86 | A | 120 | A | 1.62 | A |
| Example5 | 5 | 5 | 1.04 | A | 2.0 | B | 35.1 | 30.0 | 85 | A | 120 | A | 1.62 | A |
| Example6 | 6 | 6 | 1.05 | B | 2.9 | B | 33.8 | 27.3 | 81 | A | 115 | A | 1.61 | A |
| Example7 | 7 | 7 | 1.04 | A | 5.6 | B | 33.0 | 26.0 | 79 | B | 110 | A | 1.61 | A |
| Example8 | 8 | 8 | 1.04 | A | 6.6 | B | 31.2 | 24.0 | 77 | B | 105 | A | 1.61 | A |
| Example9 | 9 | 9 | 1.06 | B | 9.0 | B | 32.5 | 24.1 | 74 | B | 130 | B | 1.62 | A |
| Example10 | 10 | 10 | 1.12 | C | 0.6 | A | 38.5 | 35.9 | 93 | A | 150 | C | 1.58 | B |
| Example11 | 11 | 11 | 1.18 | C | 1.2 | A | 38.1 | 27.5 | 72 | B | 135 | B | 1.54 | C |
| Example12 | 12 | 12 | 1.14 | C | 1.5 | A | 37.5 | 32.1 | 86 | A | 145 | C | 1.57 | B |
| Example13 | 13 | 13 | 1.14 | C | 1.8 | A | 36.7 | 30.8 | 84 | A | 145 | C | 1.57 | B |
| Example14 | 14 | 14 | 1.15 | C | 2.1 | B | 36.8 | 30.1 | 82 | A | 145 | C | 1.57 | B |
| Comparative Example1 | 15 | 15 | 1.56 | E | 25.0 | D | 35.1 | 18.0 | 51 | D | 160 | D | 1.45 | D |
| Comparative Example2 | 16 | 16 | 1.18 | C | 14.0 | C | 27.2 | 12.1 | 44 | D | 145 | C | 1.50 | C |
| Comparative Example3 | 17 | 17 | 1.34 | E | 12.0 | C | 35.1 | 22.0 | 63 | C | 155 | C | 1.45 | D |
| Comparative Example4 | 18 | 18 | 1.42 | E | 19.0 | D | 36.7 | 21.8 | 59 | D | 160 | D | 1.42 | D |
| Comparative Example5 | 19 | 19 | 1.24 | D | 8.0 | B | 38.0 | 22.5 | 59 | D | 145 | C | 1.52 | C |
| Comparative Example6 | 20 | 20 | 1.33 | E | 14.7 | C | 37.5 | 24.5 | 65 | C | 155 | C | 1.45 | D |
| Comparative Example7 | 21 | 21 | 1.35 | E | 20.0 | D | 34.2 | 20.7 | 61 | C | 155 | C | 1.42 | D |
| Comparative Example8 | 22 | 22 | 1.30 | E | 11.0 | C | 37.2 | 16.4 | 44 | D | 150 | C | 1.45 | D |

The present invention can provide a toner in which the state of dispersion of the wax incorporated in the toner particle is controlled and in which the migration of wax to the toner particle surface is controlled.

The present invention can also provide a toner that, while providing a satisfactory low-temperature fixability and blocking resistance, can exhibit satisfactory charging performance and can do so even in a high-temperature, high-humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-029488, filed Feb. 19, 2016 which is hereby incorporated by reference herein in its entirety.

What is claimed is:

1. A method of producing a toner, comprising the steps of:

obtaining a kneaded material by melt-kneading a resin composition containing a binder resin, a colorant, a hydrocarbon wax, and a wax dispersing agent;

cooling the kneaded material to obtain a cooled material;

pulverizing the cooled material to obtain a resin particle; and heat treating the resin particle, wherein the wax dispersing agent comprises a polymer provided by graft polymerizing a styrene-acrylic polymer onto a polypropylene, the styrene-acrylic polymer is a polymer having a monomer unit derived from a cyclohexyl methacrylate, and formula (1) and formula (2) are satisfied where Mp(p) is a melting point (° C.) of the polypropylene and Mp(w) is a melting point (° C.) of the hydrocarbon wax:

$$70 \leq Mp(p) \leq 90 \quad (1)$$

$$|Mp(p) - Mp(w)| \leq 20 \quad (2).$$

2. The method of producing a toner according to claim 1, wherein the binder resin contains a crystalline polyester resin and an amorphous polyester resin.

3. The method of producing a toner according to claim 2, wherein the crystalline polyester resin is a condensation polymer of an alcohol component containing at least one compound selected from the group consisting of an aliphatic diol having 6 to 12 carbons and a derivative thereof, and a carboxylic acid component containing at least one compound selected from the group consisting of an aliphatic dicarboxylic acid having 6 to 12 carbons and a derivative thereof, and a content of the crystalline polyester resin is 1.0 to 15.0 mass parts per 100 mass parts of the amorphous polyester resin.

4. The method of producing a toner according to claim 2, wherein the crystalline polyester resin has a molecular chain terminal at which at least one aliphatic compound selected from the group consisting of an aliphatic monocarboxylic acid having 10 to 20 carbons and an aliphatic monoalcohol having 10 to 20 carbons is condensed.

* * * * *